US010015619B1

(12) United States Patent
Lee et al.

(10) Patent No.: US 10,015,619 B1
(45) Date of Patent: Jul. 3, 2018

(54) AUDIO OUTPUT DEVICE AND CONTROLLING METHOD THEREOF

(71) Applicant: SAMSUNG ELECTRONICS CO., LTD., Suwon-si, Gyeonggi-do (KR)

(72) Inventors: Yoon-jae Lee, Seoul (KR); Young-suk Song, Suwon-si (KR); Woo-jung Lee, Hwaseong-si (KR); Han-ki Kim, Suwon-si (KR); Hae-kwang Park, Suwon-si (KR); Jun-ho Sohn, Suwon-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/860,090

(22) Filed: Jan. 2, 2018

(30) Foreign Application Priority Data

Jan. 3, 2017 (KR) ..... 10-2017-0000852

(51) Int. Cl.

| | |
|---|---|
| ***H04R 5/02*** | (2006.01) |
| ***H04S 7/00*** | (2006.01) |
| ***H04R 3/04*** | (2006.01) |
| ***H04S 3/00*** | (2006.01) |

(52) U.S. Cl.
CPC ..... *H04S 7/303* (2013.01); *H04R 3/04* (2013.01); *H04R 5/02* (2013.01); *H04S 3/008* (2013.01); *H04S 2400/01* (2013.01); *H04S 2420/01* (2013.01)

(58) Field of Classification Search
CPC ..... H04R 5/02
See application file for complete search history.

(56) References Cited

U.S. PATENT DOCUMENTS

| | | | | |
|---|---|---|---|---|
| 6,148,085 | A * | 11/2000 | Jung | H04R 5/04 381/104 |
| 7,142,677 | B2 | 11/2006 | Gonopolskiy et al. | |
| 8,525,868 | B2 | 9/2013 | Forutanpour et al. | |
| 8,553,894 | B2 | 10/2013 | Berardi et al. | |
| 8,967,323 | B1 * | 3/2015 | Grenier | H04R 1/403 181/198 |
| 9,226,070 | B2 | 12/2015 | Hyun et al. | |
| 9,648,440 | B2 * | 5/2017 | Crockett | H04R 1/26 |
| 2005/0058309 | A1 * | 3/2005 | Poling | H04R 5/04 381/123 |
| 2010/0142733 | A1 | 6/2010 | Choi et al. | |

(Continued)

FOREIGN PATENT DOCUMENTS

| | | |
|---|---|---|
| KR | 10-2010-0066826 | 6/2010 |
| KR | 10-2012-0071452 | 7/2012 |
| KR | 10-2015-0093772 | 8/2015 |

*Primary Examiner* — Olisa Anwah
(74) *Attorney, Agent, or Firm* — Nixon & Vanderhye, P.C.

(57) ABSTRACT

An audio output device which outputs an audio signal that offsets a direct sound in the first speaker to offset the direct sound generated in the second speaker is provided. The audio output device according to various exemplary embodiments includes a first speaker configured to output a first audio signal, the first speaker being disposed at a first side of the audio output device, a second speaker configured to output a second audio signal, the second speaker being disposed at a second side of the audio output device, and an audio signal processor configured to control the first speaker to output the third audio signal to remove the element provided in the same direction with the first side among the second audio signal.

17 Claims, 13 Drawing Sheets

(56) References Cited

U.S. PATENT DOCUMENTS

| | | | | |
|---|---|---|---|---|
| 2013/0044884 | A1* | 2/2013 | Tammi | H04R 5/02 381/26 |
| 2014/0355797 | A1* | 12/2014 | North | H04S 5/00 381/307 |
| 2017/0289723 | A1* | 10/2017 | Yoo | H04S 3/002 |

* cited by examiner

AUDIO OUTPUT DEVICE AND CONTROLLING METHOD THEREOF

CROSS-REFERENCE TO RELATED APPLICATIONS

This application is based on and claims priority from Korean Patent Application No. 10-2017-0000852, filed on Jan. 3, 2017 in the Korean Intellectual Property Office, the disclosure of which is incorporated herein by reference in its entirety.

BACKGROUND

Field

Aspects of example embodiments relate to a speaker apparatus and/or a controlling method, and more particularly, to a speaker apparatus that controls the second audio signal output from the second speaker by using the audio signal output from the first audio signal, and/or a controlling method relating thereto.

Description of Related Art

In recent years, an audio output device has been expanded from a separated speaker device (e.g., a speaker which includes the left, right, and center speakers independently) to the product in a minimized or integrated form such as a wireless speaker device and a sound bar.

The separated speaker device has a disadvantage that it is heavy and occupies large areas compared to an integrated speaker device. Despite this disadvantage, the separated speaker device has an advantage that it may have a broad sound stage.

Specifically, the separated speaker device may realize deeper and more three-dimensional audio signal sound compared to a minimized and integrated speaker device.

In the past, a virtual sound image was expanded only with an algorithm without adding a hardware such as a speaker and an amplifier. However, recently, a hardware technology has been developed and thus a real speaker has been added to an upper portion or a side portion of a speaker device. Accordingly, the separated speaker device may output a physical signal, not a virtual signal, so as to practically expand the sound image horizontally and vertically.

Specifically, the speaker disposed at an upper portion or a side portion of a speaker device may output a sound image in a horizontal/vertical direction. Here, the output audio signal is reflected from a wall or a ceiling, and the reflected audio signal causes a listener to feel an enlargement of the sound image horizontally and vertically.

However, a part of the audio signal output from the speaker disposed at the upper portion or the side portion of the separated speaker device is transmitted to a listener without reflecting.

The audio signal directly transmitted from the upper portion or the side portion of the speaker device to a listener causes a horizontal/vertical sound image localization to be dislocated, and generates a sound degradation.

As a way to address this problem, installing a preventing plate near the speaker at the upper portion or the side portion of the speaker device has been proposed to block the audio signal transmitted directly to the listener. However, even in this case, the above described problem occurs because the sound reflected off preventing plate is transmitted to a listener, or the sound according to a diffraction is transmitted to a listener.

SUMMARY

An aspect of an example embodiment has been made to provide a method that in order to offset the element, provided in a certain direction, in the audio signal output from a speaker positioned at an upper portion and/or a side portion of an audio output apparatus, an audio signal output from speakers other than the corresponding speaker is used.

According to an example embodiment, there is provided an audio output device including an inputter configured to receive an audio source, an audio signal processor configured to process the audio source received by the inputter, a first speaker configured to output a first audio signal received from the audio signal processor, the first speaker being disposed at a first side of the audio output device, and a second speaker configured to output a second audio signal received from the audio signal processor, the second speaker being disposed at a second side adjacent to the first side of the audio output device, and the audio signal processor configured to transmit a third audio signal to offset a part of the second audio signal to the first speaker so that the third audio signal is output together with the first audio signal.

The part of the second audio signal may be a direct sound directly transmitted to a user.

The audio output device may further include a third speaker configured to output a fourth audio signal, the third speaker being disposed at a third side of the audio output device, and the first speaker may receive the third audio signal to offset a part of the fourth audio signal from the audio signal processor, and output the third audio signal together with the first audio signal.

The first side may be positioned at a front side of the audio output device, and the second side may be positioned at one of an upper portion or a side portion of the audio output device.

The third audio signal may be in a super position with the second audio signal, and offset the direct sound in the second audio signal.

The audio signal processor may process the audio source as the third audio signal by using a beamforming.

The audio signal processor may include a filter capable of processing the audio source as the third audio signal by using a transfer function, and the third audio signal may be generated by using a transfer function (HF) between the first speaker and a listener, a transfer function (HR) between the second speaker and a listener, the first audio signal (XF), and the second audio signal (XH).

In response to a plurality of first speakers existing at the first side, the third audio signal may be output through a first speaker nearest to the second speaker among the plurality of first speakers.

A frequency band of the third audio signal may be broader than a frequency band of the second audio signal.

According to an example embodiment, there is provided a controlling method of an audio output device that includes a first speaker positioned at a first side and a second speaker positioned at a second side, the method including receiving an audio source that corresponds to an audio signal to be output from the first speaker and an audio signal to be output from the second speaker, generating a third audio signal to offset a part of the second audio signal, and outputting a first audio signal and a third audio signal through the first speaker, and outputting the second audio signal through the second speaker.

The part of the second audio signal may be a direct sound directly delivered to a user.

The first side may be positioned at a front side of the audio output device, and the second side may be positioned at one of an upper portion or a side portion of the audio output device.

The third audio signal may be in a super position with the second audio signal, and offset the direct sound in the second audio signal.

The generating may include generating the third audio signal by using a beamforming.

The generating may include generating the third audio signal by using a transfer function (HF) between the first speaker and a listener, a transfer function (HR) between the second speaker and a listener, the first audio signal (XF), and the second audio signal (XH).

The outputting may include, in response to a plurality of first speakers existing at the first side, outputting the third audio signal through a first speaker nearest to the second speaker among the plurality of first speakers.

A frequency band of the third audio signal may be broader than a frequency band of the second audio signal.

As described above, there is effects that through the exemplary embodiment, the audio signal directly transmitted from the upper portion or the side portion to a listener may be removed, and the listener may listen deeper and broader audio signal.

DETAILED DESCRIPTION

Figure 1A:
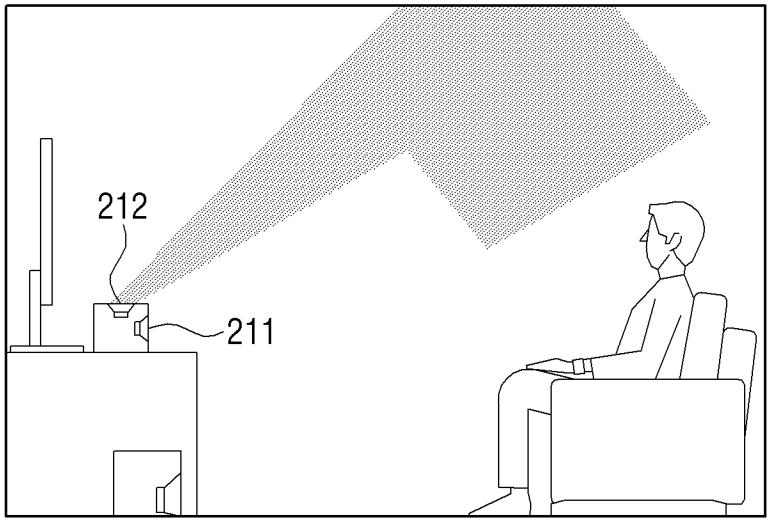
FIGS. 1A, 1B and 1C are views illustrating a problem to be solved in the exemplary embodiment.

The terms used in example embodiments will be briefly explained, and example embodiments will be described in greater detail with reference to the accompanying drawings, in which like reference numerals indicate like parts throughout the several views.

Terms used in the present disclosure are selected as general terminologies currently widely used in consideration of the configuration and functions of the present disclosure, but can be different depending on intention of those skilled in the art, a precedent, appearance of new technologies, and the like. Further, in specific cases, terms may be arbitrarily selected. In this case, the meaning of the terms will be described in the description of the corresponding embodiments. Accordingly, the terms used in the description should not necessarily be construed as simple names of the terms, but be defined based on meanings of the terms and overall contents of the present disclosure.

The example embodiments may vary, and may be provided in different example embodiments. Various example embodiments will be described with reference to the accompanying drawings. However, this is not intended to limit the scope to an exemplary embodiment, and therefore, it should be understood that all the modifications, equivalents or substitutes included under the invented spirit and technical scope are encompassed. In describing the exemplary embodiments, well-known functions or constructions are not described in detail since they would obscure the specification with unnecessary detail.

The terms such as "first," "second," and so on may be used to describe a variety of elements, but the elements should not be limited by these terms. The terms are used simply to distinguish one element from other elements.

Singular forms are intended to include plural forms unless the context clearly indicates otherwise. In the present application, the terms "include" and "comprise" designate the presence of features, numbers, steps, operations, components, elements, or a combination thereof that are written in the specification, but do not exclude the presence or possibility of addition of one or more other features, numbers, steps, operations, components, elements, or a combination thereof.

In an example embodiment, 'a module' or 'a unit' performs at least one function or operation, and may be realized as hardware (e.g., circuitry), firmware, software, or combination thereof. In addition, a plurality of 'modules' or 'units' may be integrated into at least one module and may be realized as at least one processor in an integrated manner except for 'modules' or 'units' that should be realized in specific hardware.

It will be understood that, when an element is "connected" with another element, the element may be "directly connected" with another element, and also, the element may be "electrically connected" with another element with an intervening element(s) therebetween. In addition, the element may be physically connected, and also, the element may be connected in a wireless manner. In addition, it will be understood that, when a certain part "includes" a certain element, the certain part may not exclude another element and may further include another element unless this term is defined otherwise.

Hereinbelow, certain exemplary embodiments will now be described in greater detail with reference to the accompanying drawings to enable those skilled in the art to work the same with ease. However, exemplary embodiments may be realized in a variety of different configurations, and not limited to descriptions provided herein. Further, those that are irrelevant with the description are omitted so as to describe exemplary embodiments more clearly, and similar drawing reference numerals are used for the similar elements throughout the description.

Figure 1B:
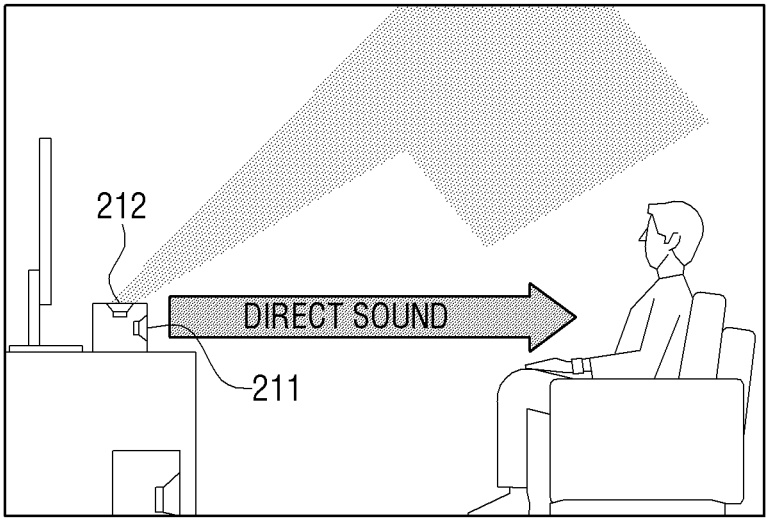
Figure 1C:
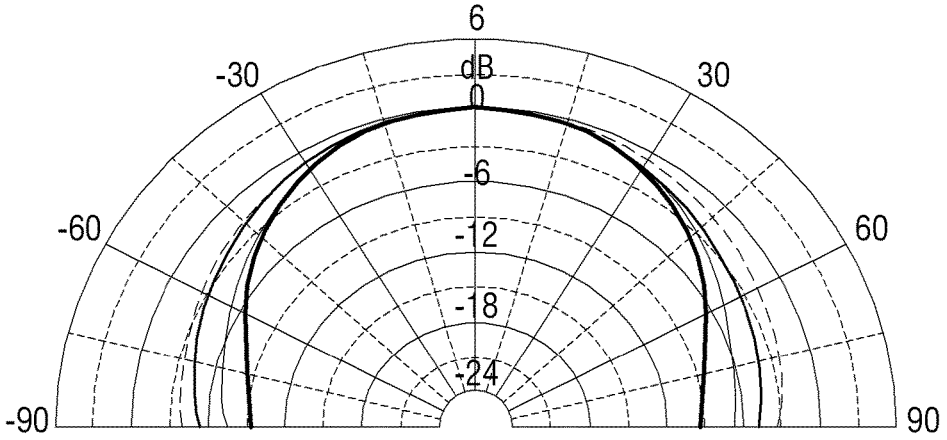

FIGS. 1A to 1C are views illustrating a problem to be solved in an example embodiment.

FIGS. 1A and 1B are views illustrating an audio signal listened to by a listener, output from an audio output device which includes a speaker unit at a front portion and an upper portion.

FIG. 1A is a view illustrating an audio signal output from an audio output device according to an example embodiment.

An audio output device may include a speaker unit at a front portion and a speaker unit at an upper portion. However, this is merely an example embodiment, and the audio output device may include a speaker unit at the side portion and rear portion in addition to the front portion and the upper portion. Hereinafter in the example embodiment, the speaker unit positioned at the front portion will be called a first speaker, the speaker unit positioned at the upper portion, the side portion, or at the rear portion will be called a second speaker, the audio signal output from the first speaker will be called a first audio signal, and the audio signal output from the second speaker will be called a second audio signal, except for a specific case.

The first speaker 211 and the second speaker 212 may output the first audio signal and the second audio signal, respectively. Specifically, the first audio signal may be output toward a listener. The second audio signal may be output toward a direction other than at the listener, for example, toward a wall or a ceiling. The second audio signal output toward the wall or ceiling may be reflected off the wall or the ceiling and transmitted to a listener. Through this technique, the listener may feel that the audio signal is transmitted from an upper portion and a side portion. Accordingly, the audio output device according to the example embodiment may cause a listener to feel the horizontal/vertical expansion of a sound image.

However, as illustrated in FIG. 1B, a part of the second audio signal output from the second speaker 212 may be directly transmitted to a listener. Specifically, some elements of the second audio signal is not reflected off a wall or a ceiling, but transmitted to a listener directly from the second speaker 212. In the exemplary embodiment, the audio signal element reflected off the wall or the ceiling among the second audio signal is called a reflecting sound, and the audio signal element directly transmitted to a listener among the second audio signal is called a direct sound.

In this case, if the second speaker 212 can offset, or at least partially offset, the direct sound that occurs accidently, the problems that a horizontal/vertical sound image localization may be dislocated and a sound degradation may be addressed and/or solved.

FIG. 1C is a view illustrating a radiation characteristic of the second audio signal output from the second speaker 212. Specifically, FIG. 1C illustrates a directional characteristic of a speaker according to the output frequency of the second audio signal. The second speaker 212 may output an audio signal from −90 degrees to 90 degrees. That is, the second speaker 212 may output a sound in an omnidirectional direction. In this case, the output sound of which angle is from 60 degrees to 90 degrees may be directly transmitted to a listener, although it depends on the position of an audio output device and a listener, and the location in which the audio output device is arranged.

Accordingly, in the implementation, the listener may listen to the direct sound in addition to the reflecting sound which occurs via the second speaker. Accordingly, the horizontal/vertical sound image localization is dislocated, and a sound degradation may be generated.

Figure 2A:
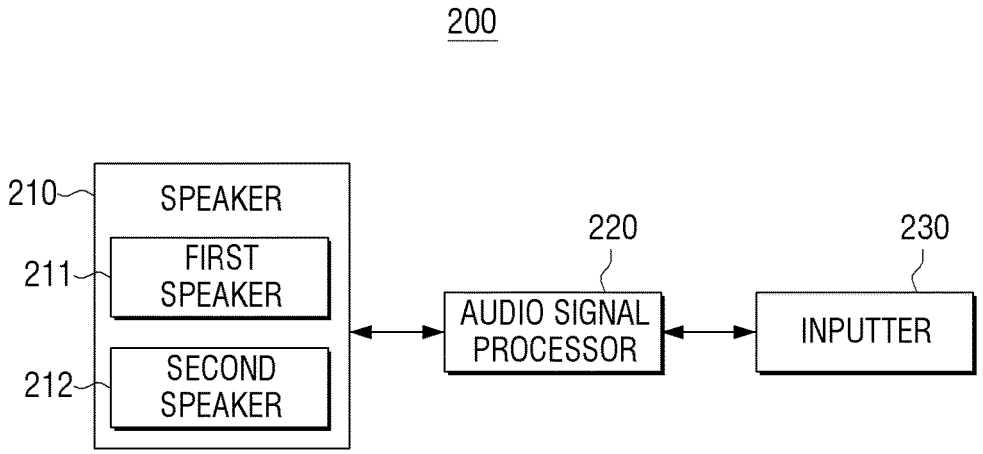
FIGS. 2A, 2B, 2C, and 2D are views illustrating a configuration of an audio output device according to an exemplary embodiment.
Figure 2B:
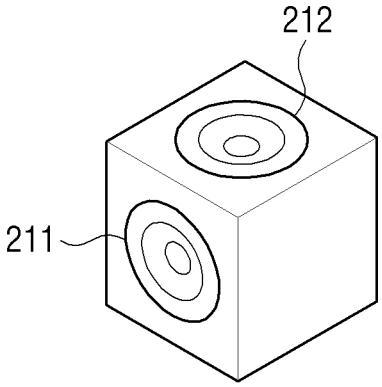

FIGS. 2A and 2B are views illustrating the configuration of an audio output device according to an example embodiment.

The audio output device 200 in FIG. 2 may include a speaker 210 and an audio signal processor 220. The audio output device 200 according to an example embodiment may be implemented as a sound bar, but this is merely an exemplary embodiment. The audio output device 200 may be implemented as a digital TV, a home theater, a computer and/or the like which can include a speaker device.

In addition, the audio output device 200 according to an example embodiment may include a speaker device which has various channels. As an example embodiment, the audio output device 200 may comprise 11.2 channel. For example, the audio output device 200 may include five front speakers to enlarge a sweet spot, two side speakers for a full-range speaker for a stable side sound image and a low frequency envelopment, two high-degree speakers which may output an audio in a frequency band greater than 1 kHz, and two sub-woofer speakers for a low frequency envelopment.

However, it is not limited thereto, and the audio output device 200 may output the audio in various channels such as 2.1 channel, 5.1 channel, 7.1.4 channel and/or the like.

The speaker 210 may include the first speaker 211 and the second speaker 212. However, it is not limited thereto, and the audio output device 200 may further include an additional speaker(s).

Here, the first speaker 211 may be located at the front portion of the audio output device 200 (e.g., see FIGS. 1A-1B). Specifically, the first speaker 211 may be positioned at a front portion of the audio output device to be pointed toward a listener and the first audio signal may be directly transmitted to a listener.

Meanwhile, the second speaker 212 may be disposed at an upper portion of the audio output device 200 (e.g., see FIGS. 1A-1B) so as to output a sound to the upper portion of the audio output device 200. Specifically, the second audio signal may be output toward a ceiling, reflected off the ceiling, and transmitted to a listener. However, it is not limited thereto, and the second speaker 212 may be positioned at one of the side portion and/or the rear portion of the audio output device 200.

Meanwhile, the first audio signal and the second audio signal may be generated from the same audio source. That is, the audio source processed in the audio signal processor 220 (including processing circuitry) may be output as the first audio and the second audio through the first speaker 211 and the second speaker 212, respectively.

The first speaker 211 may output the first audio signal and a third audio signal, and the second speaker 212 may output the second audio signal. The first audio signal and the second audio signal are the audio signals which process the audio source input from the audio output device 200 appropriately for the characteristic of each speaker and output the processed audio source. The third audio signal is the audio signal for offsetting the direct sound, directly transmitted to a listener, in the second audio signal. Specifically, the third audio signal may be in a super position with the direct sound of the second audio signal and offset the direct sound.

It has been described above that the audio output device 200 includes the first speaker 211 and the second speaker 212. But other speakers may be added. For example, the audio output device 200 may have speakers at a front portion, an upper portion and a side portion thereof. In this case, the third speaker disposed at the side portion of the audio output device 200 may output a fourth audio signal.

Here, the fourth audio signal may be output toward a side portion. Specifically, the fourth audio signal may be output toward the side portion, reflected off a wall and transmitted to a listener. Here, the third audio signal may be the audio signal for offsetting the audio signal element which faces the front, in the second audio signal and the fourth audio signal.

The audio signal processor 220 may generate the first to the third audio signals by processing an audio source. Specifically, the audio signal processor 220 may process an audio source in order to output the third audio signal to offset the audio signal element which faces the front, in the second audio signal.

The audio signal processor 220 may process an audio source so as to output the third audio signal to offset the direct sound of the second audio signal by a principle of superposition. Here, the third audio signal may be an audio signal which has a phase difference of substantially 90 degrees (i.e., 90 degrees plus/minus 10 degrees) with the direct sound of the second audio signal.

Meanwhile, the audio signal processor 220 may include various filters to process the audio source. Specifically, the audio signal processor 220 may include a filter to output the third audio signal by using a beamforming and/or a transfer function, which will be described below. However, it is not limited to this configuration, and filters may be added or omitted as desired.

The inputter 230 (including input/interface circuitry which may be made up of or include a terminal) may receive an audio source and transmit the audio source to the audio signal processor 220.

FIG. 2B is a front view illustrating an audio output device 200 according to an example embodiment.

As described above, the audio output device 200 may include a first speaker 211 and a second speaker 212, and additional speakers may also be included.

Meanwhile, although FIG. 2B merely illustrates the case in which the audio output device 200 is rectangular, the shape of the audio output device 200 is not limited to any one shape. For example, the audio output device 200 may be in a shape of sphere, square, or in a streamlined shape. In addition, the position of the first speaker 211 and the second speaker 212 may vary. That is, if the audio output device 200 includes the speaker of which an audio signal is directly transmitted to a listener, and the speaker of which an audio signal is not directly transmitted to a listener, the audio output device 200 may be implemented in any suitable shape which can be analogized by those skilled in the related art.

In addition, the audio output device 200 may be an audio output device which includes a plurality of first speakers 211 and a plurality of second speakers 212. Specifically, the plurality of first speakers 211 may be positioned at the left, right, and center of the audio output device 200 respectively, and may output the audio signal corresponding to each of these positions. As the plurality of first speakers 211, the plurality of second speakers 212 may be positioned at the left, right, and center of the audio output device 200 respectively, and may output the audio signal corresponding to each of these positions.

In this case, the audio output device 200 may output a plurality of third audio signals to offset the direct sound of the plurality of second audio signals output from each of the plurality of second speakers 212.

Here, the third audio signal may be output from the first speaker 211 located nearest to the second speaker 212 from which the direct sound of the second audio signal is output. That is, the first speaker 211 located nearest to each of the second speaker 212 may output the third audio signal corresponding to the direct sound of each of the second audio signal. An example operation in this respect will be illustrated later with reference to FIG. 5.

Meanwhile, the frequency band of the third audio signal may be broader than the frequency band of the second audio signal. Specifically, the speaker mounted on the audio output device 200 may be a sub-woofer, a woofer, a mid-woofer, a squawker (midrange speaker) twitter, a super twitter and the like. These various speakers have different frequency bands, respectively. If the frequency band of the second audio signal is greater than that of the third audio signal, the audio signal in the frequency band which may not be output by the first speaker 211 may not be offset. Accordingly, the first speaker 211 may be the speaker which outputs the audio signal of which a frequency band is greater than that of the second speaker 212.

Figure 2C:
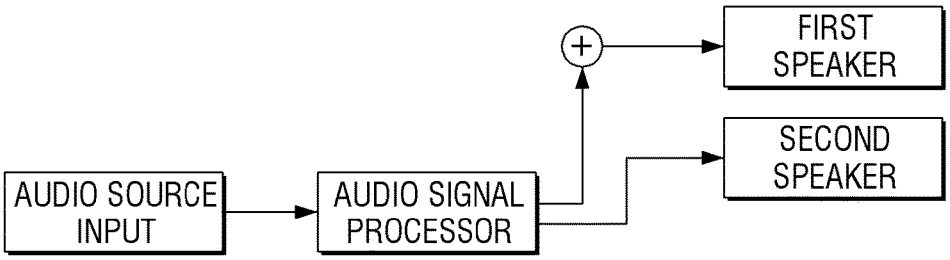

FIG. 2C is a flow chart illustrating the process for offsetting a direct sound by an audio output device according to an example embodiment.

First, if an audio signal source is input to an audio output device, the audio signal processor 220 may perform signal processing so that the input audio signal source corresponds to each speaker. Here, various filters for signal processing may be used. For example, as illustrated in FIGS. 3 and 4, the audio signal processor 220 may perform the signal processing by using a filter(s) that controls a beamforming and/or a filter constructed to satisfy a preset transfer function.

Here, the first speaker 211 and the second speaker 212 may output the audio signal processed in the audio signal processor 220. Specifically, the first speaker 211 may output the first audio signal and the third audio signal, and the second speaker 212 may output the second audio signal.

That is, the audio output device 200 may output the first audio signal, the second audio signal, and the third audio signal, and the listener listening to the output audio signal may feel like the audio signal is output from a front portion or an upper portion.

Meanwhile, FIG. 2C illustrates that the audio output device 200 includes the first speaker 211 and the second speaker 212, but it is not limited thereto. Specifically, as illustrated in FIG. 2D, it is also possible for a third speaker(s) to be positioned at the side portion of the audio output device 220, and the direct sound may be offset in method similar manner.

Figure 2D:
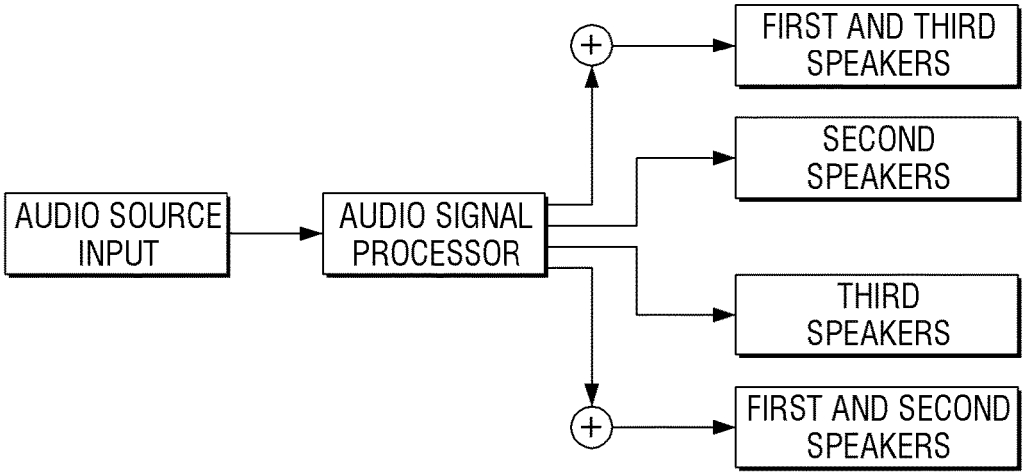

In the case of FIG. 2D, the second audio output from the second speaker 212 faces an upper portion, and the fourth audio output from the third speaker may face a side portion. Here, the second audio and the fourth audio may include a direct sound.

Here, the third audio signal output from the first speaker 211 may be an audio signal to offset the direct sound of the second audio signal and the direct sound of the fourth audio signal output from the second speaker 212 and the third speaker (not illustrated).

However, it is not limited to this configuration, and the speaker which outputs the third audio that offsets the direct sound of the second speaker may be one of the first speaker and the third speaker except for the second speaker. In addition, the speaker which outputs the third audio that offsets the direct sound of the second speaker may be both the first speaker and the third speaker, except for the second speaker.

The same method may be applied to the third speaker. Specifically, the speaker which outputs the third audio that offsets the direct sound of the third speaker may be one of the first speaker and the second speaker, but not the third speaker. In addition, the speaker which outputs the third audio that offsets the direct sound of the third speaker may be both the first speaker and the second speaker, but not the third speaker.

Figure 3A:
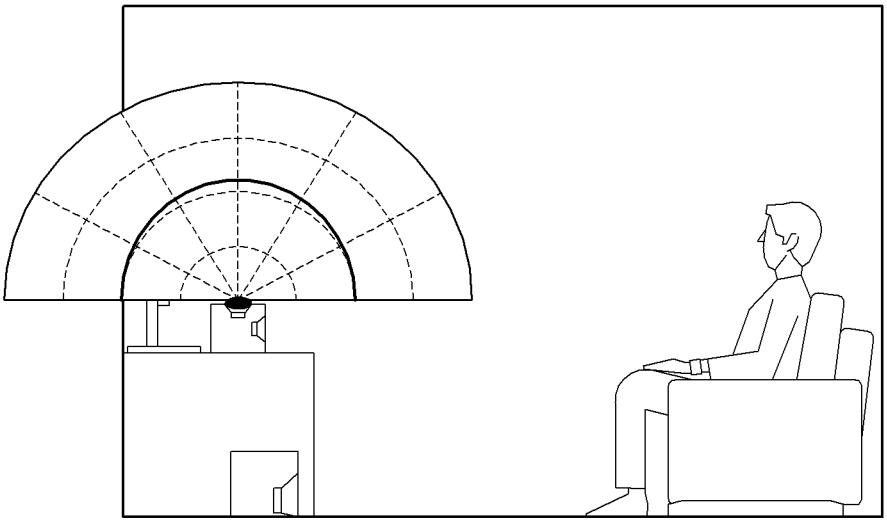
FIGS. 3A and 3B are views illustrating a method for offsetting a direct sound using a beamforming according to an exemplary embodiment.
Figure 3B:
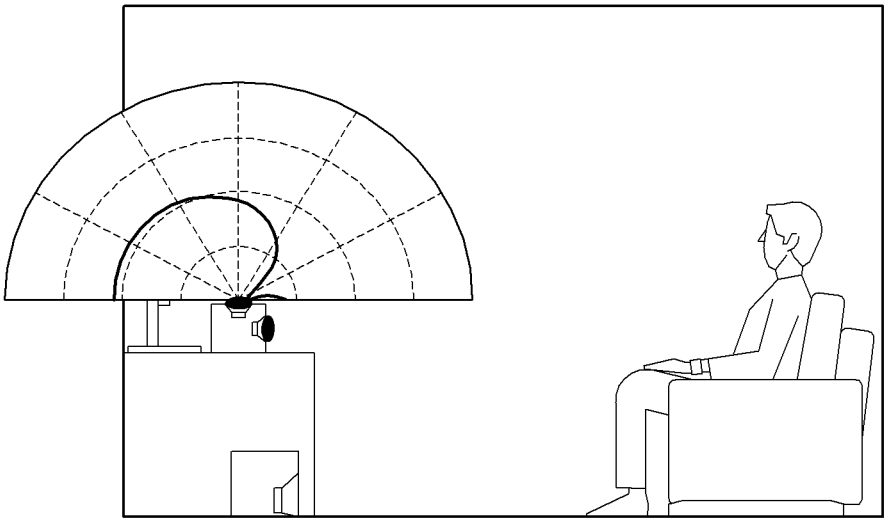
Figure 4:
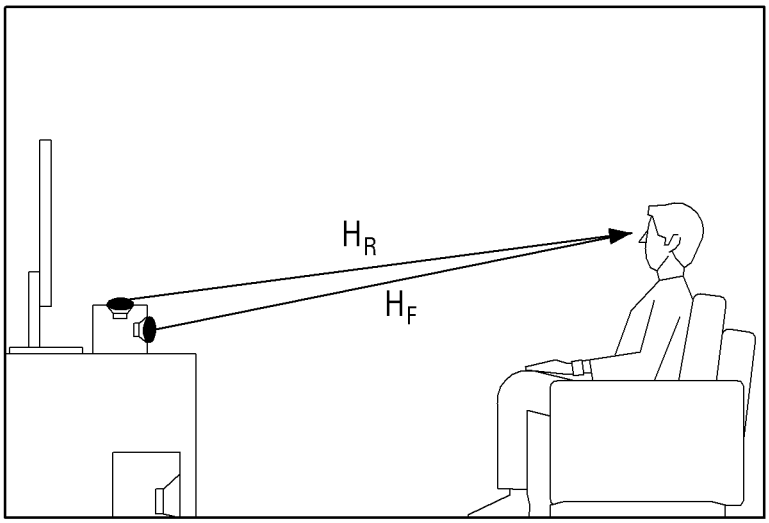
FIG. 4 is a view illustrating a method for offsetting a direct sound using a transfer function.

FIGS. 3A and 3B are views illustrating a method to offset the direct sound using a beamforming method according to an example embodiment.

In general, a beamforming method is one of signal processing methods used to adjust a direction or a sensitivity of a radiation pattern using the arrangement of a transmitting device or a receiving device, or to enhance the intensity of a signal by superimposing the signals.

In an example embodiment, the beamforming may be applied by using the speaker at the side portion or the upper portion and the first speaker, positioned at the front side in order to suppress the signal reached to the front side of a listener among the audio signal of the side portion or the upper portion.

Specifically, the third audio signal output from the first speaker 211 may be generated using the beamforming method. That is, the audio signal processor 220 may generate the third audio signal so as to offset the direct sound of the second audio signal.

Specifically, the audio signal processor 220 may include different filters which suppress the radiation facing a listener. The audio source which went through the audio signal processor 220 may be transformed into the second audio signal and the third audio signal of which a size and a phase are changed for each frequency, and output from the second speaker and the first speaker respectively. Reproduced two signals may be a signal in a new form in which a signal is suppressed toward a listener.

In addition, FIG. 3 illustrates the case in which the second speaker 212 is positioned at the upper portion of the audio output device 200, but the second speaker 212 may be positioned at the side portion of the audio output device 200 and also at various positions such as a side portion, an upper portion, a rear portion and the like.

FIG. 4 is a view illustrating a method for offsetting the direct sound using a transfer function according to an example embodiment.

FIG. 4 illustrates the method for offsetting the direct sound of the second audio signal by using a transfer function between the first speaker 211, the second speaker 212 and a listener. In this case, the audio signal processor 220 may include a filter(s) to generate the third audio signal.

In order to realize the filter using the transfer function, the transfer function between the first speaker and the listener and the transfer function between the second speaker and the listener may be a pre-measured or predetermined value.

If the transfer function between the first speaker and the listener is HF, the transfer function between the second speaker and the listener is HR, the first audio signal is XF, and the second audio signal is XH, the third audio signal may be shown as the following equation.

$$\text{The third audio} = -H_R * X_H / H_F \quad \text{[Equation 1]}$$

Here, the audio signal output from the first speaker 211 is the sum of the first audio and the third audio, and thus it is shown as equation 2.

$$\text{The first speaker output signal} = XF - (H_R * X_H / H_F) \quad \text{[Equation 2]}$$

As illustrated in FIG. 3, the second speaker 212 may be positioned at the side portion in addition to the upper portion of the audio output apparatus 200 and may be positioned both in the side portion and the upper portion, also in FIG. 4.

However, FIGS. 3 and 4 are merely exemplary embodiments, and it is not limited thereto. The method that the first speaker 211 generates the third audio signal to offset the direct sound of the second audio signal output from the second speaker 212 may vary.

In addition, in an exemplary embodiment, the first speaker 211 outputs the third audio signal to offset the direct sound of the second audio signal, but it is not limited thereto. For example, if it is appropriate that the third speaker disposed at a side portion offsets the direct sound of the second audio signal, the third speaker may output the third audio signal to offset the direct sound of the second audio signal.

Figure 5A:
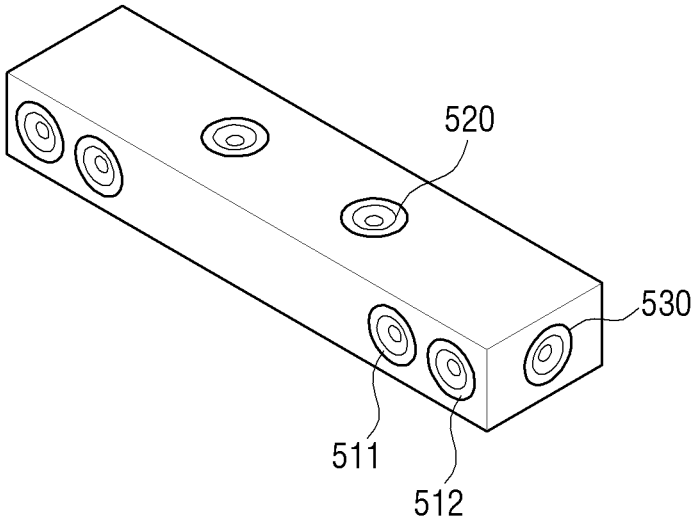
FIGS. 5A, 5B, and 5C are views illustrating an audio output device according to an exemplary embodiment.
Figure 5B:
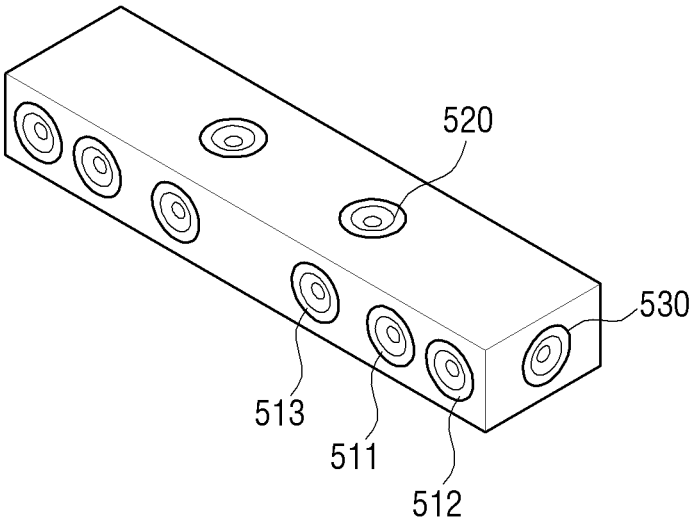
Figure 5C:
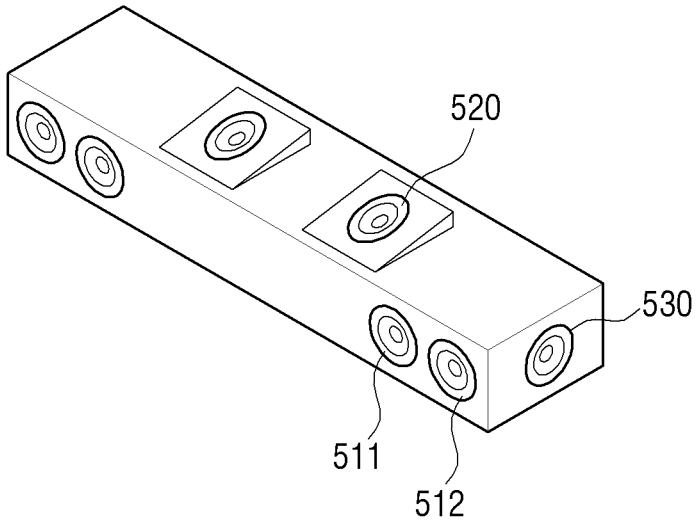

FIGS. 5A to 5C are drawings illustrating an audio output device according to an exemplary embodiment.

FIG. 5A is the audio output device 200 according to an exemplary embodiment.

Specifically, the audio output device in FIG. 5A includes a plurality of speakers at the front, side, and upper portions. Specifically, the audio output device 200 may include the first front speaker 511, the second front speaker 512, an upper speaker 520 and a side speaker 530 on the right side, and include speakers on the left side to correspond to the right side. Here, the front speakers 511 and 512 are used to offset the direct sound generated in the upper speaker 520 and a side speaker 530 may be the nearest speaker positioned at the side adjacent to the upper speaker 520 and the side speaker 530 respectively.

That is, the speaker which outputs the third audio signal which offsets the direct sound of the second audio signal output from the upper speaker 520 may be the first front speaker 511 positioned nearest to the upper speaker 520, and the speaker which outputs the audio signal that offsets the direct sound of an audio signal output from the side speaker 530 may be the second front speaker 512 nearest to the side speaker 530. However, it is not limited thereto, and the first front speaker 511 may offset the direct sound generated in the upper speaker 520 and the side speaker 530, and other speakers may offset the direct sound.

FIG. 5B is another exemplary embodiment. Specifically, FIG. 5B may include the third front speaker 513 in addition to the speaker illustrated in FIG. 5A. Here, the third front speaker 513 may output only the third audio signal to offset the direct sound output from the upper speaker 520. Specifically, the third front speaker 513 may be disposed at the optimum position to offset the direct sound output from the upper speaker 520. For example, the optimum position may be the position nearest to the center of the upper speaker 520. However, it is not limited thereto, and the speaker which outputs only the audio signal to offset the direct sound may be disposed at the upper portion or the side portion of the audio output device 200, or may be constructed as an independent speaker device separated from the audio output device 200.

FIG. 5C is another exemplary embodiment. Specifically, as illustrated in FIG. 5C, the audio output device 200 may adjust the direction and an angle of the upper speaker 520. That is, the upper speaker 520 may be changed from FIG. 5A to FIG. 5C according to the command of a listener and the like. That is, the upper speaker 520 may move/tilt toward the front speakers 511, 512 and 513 to provide an optimum audio to a listener. However, it is not limited thereto, and the upper speaker 520 may move toward the direction opposite to the front speakers 511, 512 and 513 or toward the side speaker 530.

If the direction and the angle of the upper speaker 520 are adjusted, the audio signal processor 220 may output the third audio signal which offsets the direct sound of the upper speaker 520 in response to the changed direction and angle.

Meanwhile, in FIG. 5C, it has been described that the direction and the angle of the upper speaker 520 can be adjusted, but it is not limited thereto, and the direction and the angle of the side speaker 530 may be adjusted.

In addition, it has been described that the direction and the angle of the upper speaker 520 and the side speaker 530 may be adjusted, but it is not limited thereto, and the position of the upper speaker 520 and the side speaker 530 may be adjusted.

Meanwhile, in FIG. 5, the audio output device 200 has been described as a rectangular as an example, but it is not limited thereto, and aspects of an exemplary embodiment may be applied to the audio output device 200 in various forms.

The exemplary embodiments may be recorded in a computer-readable recording medium by being embodied as a program command which can be executed through various computer methods. The computer-readable recording medium may include a program command, a data file, a data configuration and a combination thereof. Program commands recorded on the medium are specially designed and configured for the present disclosure or may be well known to a person skilled in the field of computer software and may be used. Examples of the computer-readable medium include magnetic recording media such as hard disks, floppy disks and magnetic tapes, optical recording media such as CD-ROMs and DVDs, magneto-optical recording media such as floptical disks, and hardware devices such as ROMs, RAMs and flash memories that are especially configured to store and execute program commands. Examples of the program commands include machine language codes created by a compiler, and high-level language codes that can be executed by a computer by using an interpreter. The hardware device may be configured to operate as one or more software modules to perform the operation of the present disclosure, and the reverse can be applied.

Although exemplary embodiments have been shown and described, it will be appreciated by those skilled in the art that changes may be made to the exemplary embodiments without departing from the principles and spirit of the present disclosure. Accordingly, the scope of the present disclosure is not construed as being limited to the described exemplary embodiments, but is defined by the appended claims as well as equivalents thereto.

What is claimed is:

1. An audio output device comprising:

an input circuitry configured to receive an audio source;

an audio signal processor configured to process the audio source received by the input circuitry;

a first speaker configured to output a first audio signal received from the audio signal processor, the first speaker being disposed at a first side of the audio output device; and a second speaker configured to output a second audio signal received from the audio signal processor, the second speaker being disposed at a second side, adjacent to the first side, of the audio output device, wherein the audio signal processor is configured to transmit a third audio signal to the first speaker, to offset a part of the second audio signal, so that the third audio signal is output together with the first audio signal via the first speaker.

2. The audio output device as claimed in claim 1, wherein the part of the second audio signal is a direct sound to be directly transmitted to a listener.

3. The audio output device as claimed in claim 1, further comprising:

a third speaker configured to output a fourth audio signal, the third speaker being disposed at a third side of the audio output device, wherein the first speaker receives the third audio signal to offset a part of the fourth audio signal from the audio signal processor, and outputs the third audio signal together with the first audio signal.

4. The audio output device as claimed in claim 1, wherein the first side is positioned at a front side of the audio output device and is adapted to face a listener, and wherein the second side is positioned at one of an upper portion or a side portion of the audio output device.

5. The audio output device as claimed in claim 1, wherein the third audio signal is in a super position with the second audio signal, and offsets the direct sound in the second audio signal.

6. The audio output device as claimed in claim 1, wherein the audio signal processor is configured to process the audio source as the third audio signal by using a beamforming.

7. The audio output device as claimed in claim 1, wherein the audio signal processor comprises a filter capable of processing the audio source as the third audio signal by using a transfer function, and wherein the audio signal processor is configured so that the third audio signal is to be generated using a transfer function (HF) between the first speaker and a listener, a transfer function (HR) between the second speaker and a listener, the first audio signal (XF), and the second audio signal (XH).

8. The audio output device as claimed in claim 1, wherein, in response to a plurality of first speakers existing at the first side, the third audio signal is to be output through a first speaker nearest to the second speaker among the plurality of first speakers.

9. The audio output device as claimed in claim 1, wherein a frequency band of the third audio signal is broader than a frequency band of the second audio signal.

10. A controlling method of an audio output device that includes a first speaker positioned at a first side and a second speaker positioned at a second side, the method comprising:

receiving an audio source that corresponds to a first audio signal to be output from the first speaker and a second audio signal to be output from the second speaker;

generating a third audio signal to offset a part of the second audio signal; and outputting the first audio signal and the third audio signal through the first speaker, and outputting the second audio signal through the second speaker.

11. The method as claimed in claim 10, wherein the part of the second audio signal is a direct sound directly delivered to a user.

12. The method as claimed in claim 10, wherein the first side is positioned at a front side of the audio output device, and wherein the second side is positioned at one of an upper portion or a side portion of the audio output device.

13. The method as claimed in claim 11, wherein the third audio signal is in a super position with the second audio signal, and offsets the direct sound in the second audio signal.

14. The method as claimed in claim 10, wherein the generating comprises generating the third audio signal by using a beamforming.

15. The method as claimed in claim 10, wherein the generating comprises generating the third audio signal by using a transfer function (HF) between the first speaker and a listener, a transfer function (HR) between the second speaker and a listener, the first audio signal (XF), and the second audio signal (XH).

16. The method as claimed in claim 10, wherein the outputting comprises, in response to a plurality of first speakers existing at the first side, outputting the third audio signal through a first speaker nearest to the second speaker among the plurality of first speakers.

17. The method as claimed in claim 10, wherein a frequency band of the third audio signal is broader than a frequency band of the second audio signal.

* * * * *